United States Patent [19]

Cheskin

[11] Patent Number: 4,676,010

[45] Date of Patent: Jun. 30, 1987

[54] VULCANIZED COMPOSITE SOLE FOR FOOTWEAR

[75] Inventor: Melvyn P. Cheskin, Braintree, Mass.

[73] Assignee: Quabaug Corporation, North Brookfield, Mass.

[21] Appl. No.: 855,166

[22] Filed: Apr. 23, 1986

Related U.S. Application Data

[63] Continuation-in-part of Ser. No. 743,041, Jun. 10, 1985.

[51] Int. Cl.[4] ..... A43B 13/04; A43B 13/16; A43B 13/18

[52] U.S. Cl. ..... 36/32 R; 36/30 R; 36/31; 36/59 A; 36/114

[58] Field of Search ..... 36/32 R, 30 R, 31, 25 R, 36/114, 129, 83, 59 R, 59 A, 59 C

[56] References Cited

U.S. PATENT DOCUMENTS

| | | | |
|---|---|---|---|
| 4,085,526 | 4/1978 | Hemmer . | |
| 4,130,947 | 12/1978 | Denu | 36/32 R |
| 4,255,874 | 3/1981 | Sironi . | |
| 4,271,606 | 6/1981 | Rudy | 36/32 R |
| 4,335,530 | 6/1982 | Stubblefield | 36/30 R |
| 4,439,936 | 4/1984 | Clarke et al. | 36/32 R |
| 4,455,765 | 6/1984 | Sjosward | 36/32 R |
| 4,551,930 | 11/1985 | Graham et al. | 36/30 R |
| 4,614,046 | 9/1986 | Dassler | 36/30 R |

FOREIGN PATENT DOCUMENTS

| | | | |
|---|---|---|---|
| 405156 | 11/1909 | France | 36/59 R |
| 58-49101 | 3/1983 | Japan | 36/30 R |
| 24694 | of 1897 | United Kingdom | 36/59 R |
| 298718 | 10/1928 | United Kingdom | 36/30 R |
| 2151455 | 7/1985 | United Kingdom | 36/129 |

OTHER PUBLICATIONS

Brooks–Think of it as Software for your Feet, 1985 Brooks Shoe Inc, Rockford, MI 49851, A subsidary of Wolvering World Wide Inc.

*Primary Examiner*—James Kee Chi

*Attorney, Agent, or Firm*—I. Stephen Samuels

[57] ABSTRACT

A lightweight, flexible, resilient sole adapted for athletic footwear including a relatively soft midsole made of a synthetic such as ethylene vinyl acetate, the midsole being wedge-shaped and including a relatively thick heel section and a relatively thin and flexible forepart section, and a plurality of discontinuous independent outsole pieces made of a relatively hard and wear-resistant synthetic rubber, such as styrene-butadiene rubber, the outsole pieces being disposed across the forepart section of the midsole with open spaces between the outsole pieces to maintain the flexibility of the forepart section, with the outsole pieces being vulcanized to the lower surface of the midsole to form a composite sole.

11 Claims, 8 Drawing Figures

Fig. 6
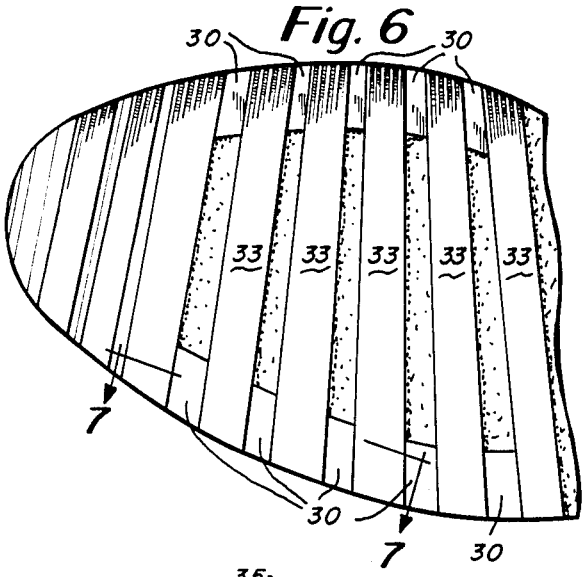
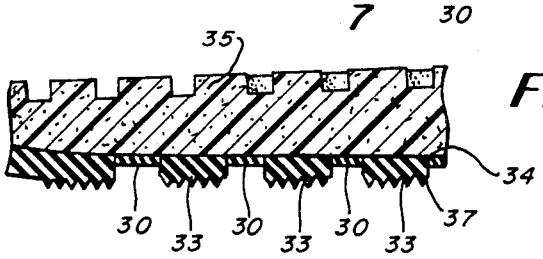
Fig. 7

VULCANIZED COMPOSITE SOLE FOR FOOTWEAR

CROSS-REFERENCE TO RELATED APPLICATIONS

This application is a continuation-in-part of U.S. Ser. No. 743,041, filed June 10, 1985, and now pending.

BACKGROUND OF THE INVENTION

This invention relates to a sole for athletic footwear, and more particularly to a vulcanized composite sole which is lightweight and flexible.

The principal design considerations for a running shoe are weight, cushioning, flexibility, motion control, stability and durability. Typically, in a running shoe, the midsole provides the cushioning and the outsole provides the traction and durability. Different portions of the midsole and the outsole are subjected to different degrees of wear, with the heel and forepart portions being the areas of highest wear. Further, certain areas of the outsole are required to be more flexible, such as the forepart section.

A typical running shoe sole consists of a prefabricated midsole-wedge unit to which a hard rubber outsole is attached. The hard rubber outsole is typically a unitary piece having downwardly extending lugs or other projections for traction. This unitary outsole construction contributes significant weight to and contributes significant stiffness to the running shoe. It is also known to provide a central cut-out in the arch region of the outsole to reduce the weight of the shoe.

It is an object of the present invention to provide a lightweight and flexible sole for footwear.

It is another object to provide a resilient and long-wearing sole which is easy to manufacture.

It is a further object to this invention to provide a sole which allows elaborate cosmetic and functional variations on the outsole.

SUMMARY OF THE INVENTION

The sole of this invention is especially adapted for athletic footwear, such as running shoes.

The sole includes a relatively soft midsole made of a soft rubber-like elastomer. The midsole is wedge-shaped and has a relatively thick heel section and a relatively thin and flexible forepart section. The sole further includes a plurality of discontinuous independent outsole pieces of relatively hard rubber in comparison to the midsole. The outsole pieces are disposed across the forepart section of the midsole with open spaces between the separate outsole pieces. The outsole pieces thus provide a durable forepart section of the sole without substantially increasing the weight of the sole. The outsole pieces are attached to the lower surface of the midsole by vulcanization to produce a composite sole.

In a preferred embodiment, the midsole is made from a a soft rubber-like elastomer, such as ethylene vinyl acetate or polyurethane, and the outsole pieces are made from styrene-butadiene rubber. The outsole pieces comprise strips extending transversely across the forepart section of the sole, with forwardly extending offset portions of the outsole piece strips further enhancing the flexibility of the forepart section. A few smaller outsole pieces are provided at the arch, heel and toe regions of the sole. These additional outsole pieces are entirely independent from the outsole pieces at the forepart region. There are no outsole pieces located at many regions of the sole, as can be easily seen in FIG. 2. This reduces the weight of the sole. Furthermore, the outsole pieces may be made from more than one color or type of hard rubber in order to have different aesthetic or functional characteristics.

BRIEF DESCRIPTION OF THE DRAWINGS

FIG. 6 is a fragmentary top view of the toe and forepart sections of a second embodiment of the sole of this invention.

FIG. 7 is a fragmentary, cross-sectional view of the forepart section of the sole taken along section lines 7—7 of FIG. 6.

DETAILED DESCRIPTION OF A PREFERRED EMBODIMENT OF THE INVENTION

Figure 1:
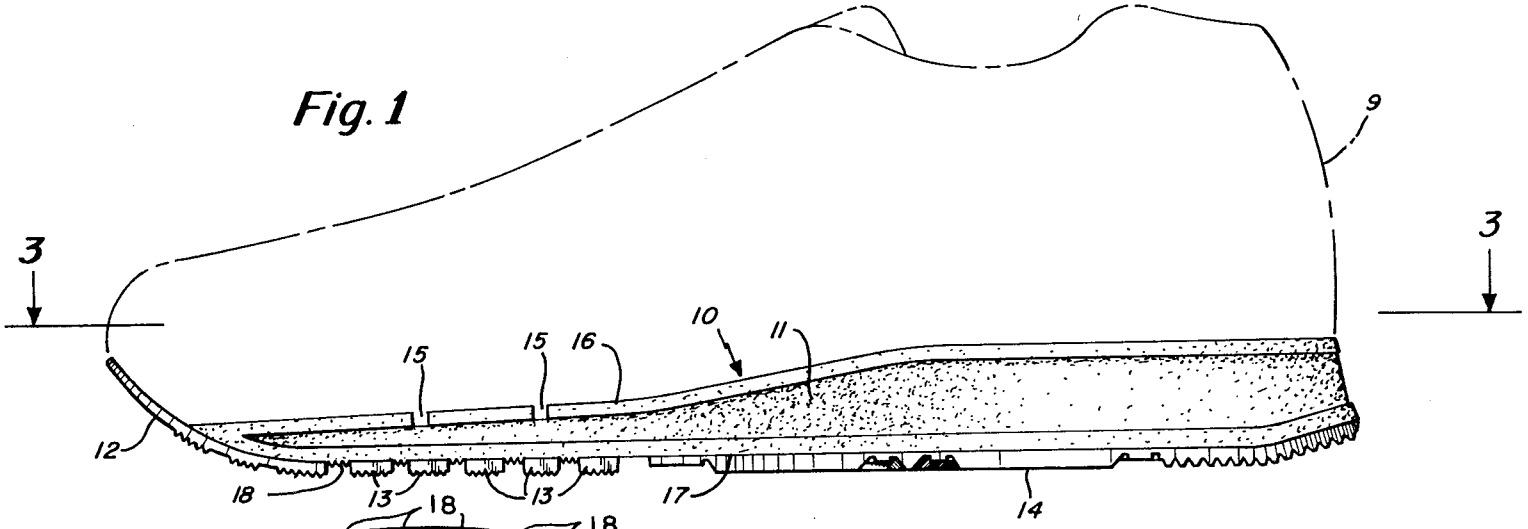
FIG. 1 is a side view of the sole of this invention with a shoe upper shown in phantom lines.
Figure 2:
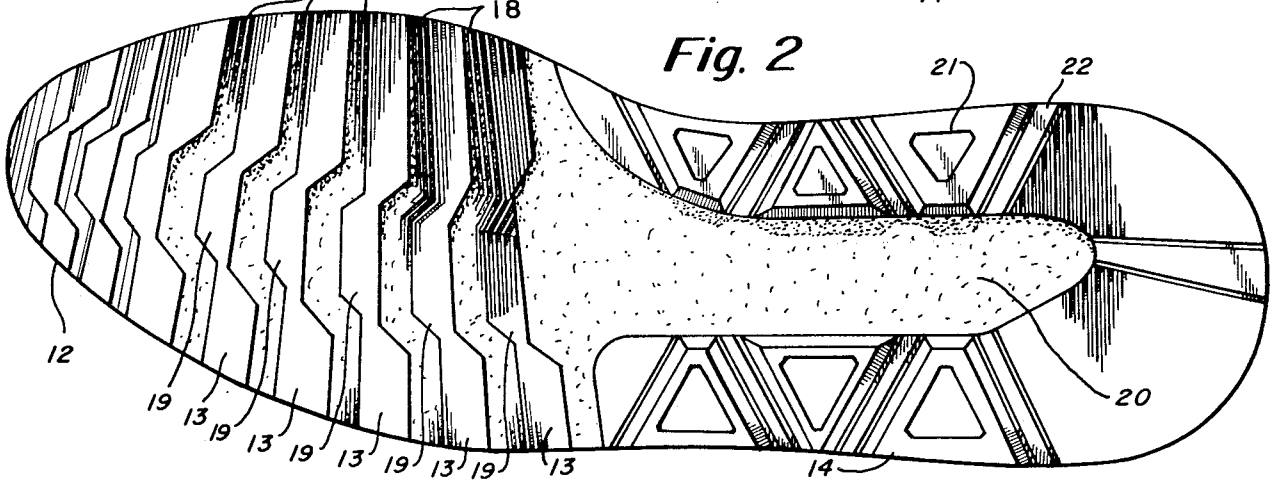
FIG. 2 is a bottom view of the sole of FIG. 1.
Figure 3:
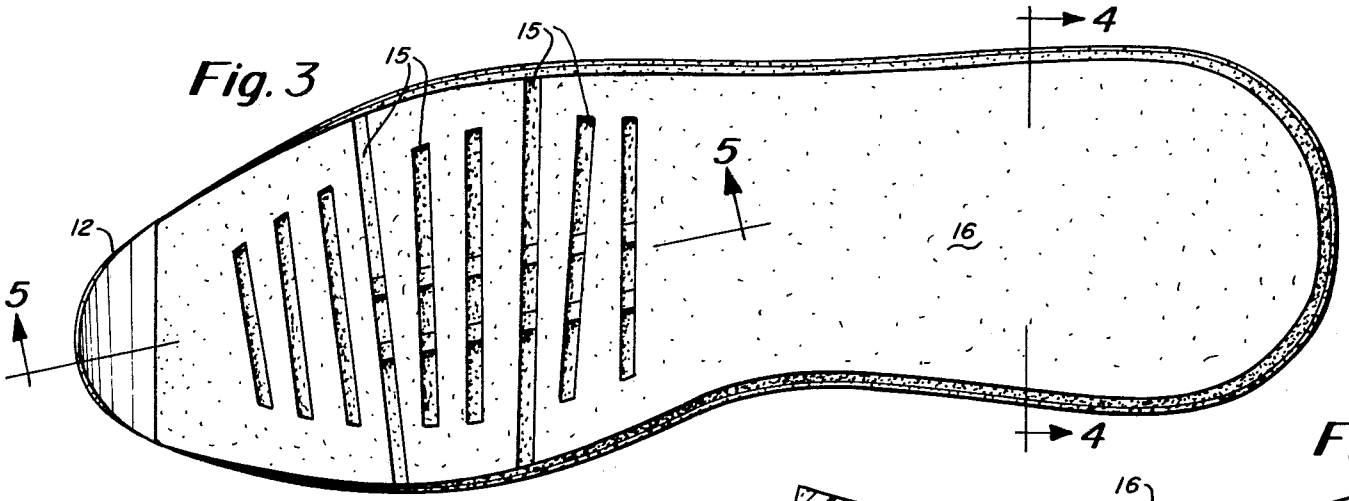
FIG. 3 is a top view of the sole of this invention taken along section lines 3—3 of FIG. 1.
Figure 4:
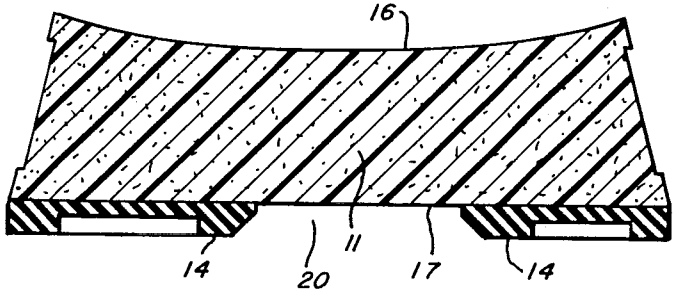
FIG. 4 is a cross-sectional view of the heel section of the sole taken along section lines 4—4 of FIG. 3.

A preferred embodiment of the sole 10 of this invention for a running shoe is shown in FIGS. 1-5 (a shoe upper is shown in phantom lines in FIG. 1). The sole includes a relatively soft, wedge-shaped midsole 11 and a plurality of discontinuous, independent outsole pieces which are vulcanized to the lower surface of the midsole. The outsole pieces 12 are located at the toe section; the outsole pieces 13 are located at the forepart section; and the outsole pieces 14 are located in the arch and heel sections of the sole.

The midsole 11 is made from a relatively soft rubber-like elastomer such as ethylene vinyl acetate (EVA) or polyurethane foam. These materials are lightweight, flexible, and resilient. The midsole is formed into a wedge shape having a relatively thicker rear section at the heel and a relatively thinner and therefore more flexible front section at the forepart and toe. A plurality of transversely extending spaced grooves 15 is provided in the upper surface 16 of the midsole and is disposed across the forepart section of the midsole to further increase the flexibility of the forepart section of the midsole. The midsole can be molded from a single block, or different portions of the midsole can be molded from a number of harder and/or softer blocks to vary the cushioning, motion control or stability characteristics at different portions of the sole.

Figure 5A:
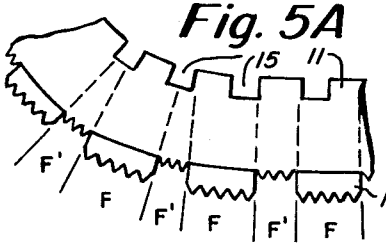
FIG. 5A is a fragmentary schematic view of the sole showing the forepart and toe sections.
Figure 5:
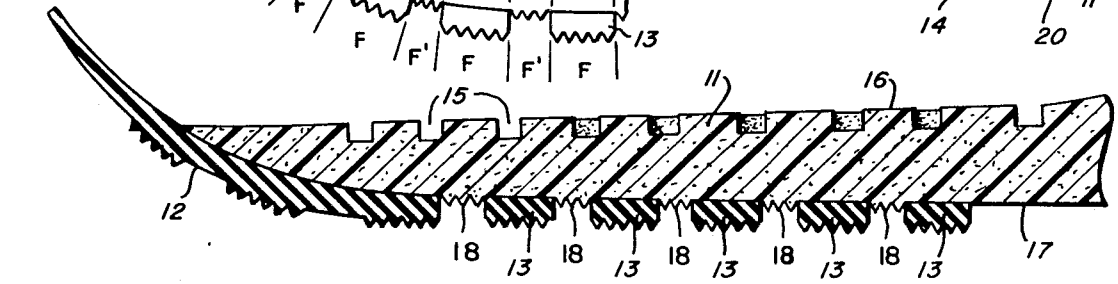
FIG. 5 is a fragmentary cross-sectional view of the forepart and toe sections of the sole taken along section lines 5—5 in FIG. 3.

The outsole pieces 12, 13, 14 are made of a relatively hard synthetic rubber in comparison to the midsole and are vulcanized to the bottom surface 17 of the midsole in order to form a composite. The outsole pieces are made of a wear-resistant synthetic rubber such as styrene-butadiene rubber (SBR). By forming the outsole pieces as discontinuous independent strips across the forepart section of the sole, the necessary wear-resistance is achieved with minimal increase in weight. Furthermore, the open spaces F' between the outsole pieces enhance the flexibility of the forepart section as shown in FIG. 5A. Tread 18 (see FIG. 1) may be formed in the lower surface 17 of the midsole 11 between the outsole pieces 13 to improve traction.

In a preferred embodiment, the outsole pieces 13 at the forepart section are arranged in substantially parallel strips extending trannsversely across the forepart section between opposing side edges of the sole. It is further preferred to provide forwardly extending offset portions 19 in the transversely extending outsole pieces 13 to further enhance the flexibility of the forepart section.

The sole also includes outsole pieces 12 at the toe section, and outsole pieces 14 at the arch and heel sections, which outsole pieces may be either continuous or discontinuous. Due to the high level of wear at the toe section, a continuous (connected) outsole piece 12 with tread may be provided. At the arch and heel, a generally U-shaped outsole piece 14 may be provided with a central cut-out 20 along the axis of the foot and the arch section of the sole in order to reduce weight since the arch section is not subjected to a high level of wear. Various tread designs 21 and strips 22 of different colors may be included in the outsole pieces to produce a large range of cosmetic and functional variations in the sole.

In a second preferred embodiment, shown in FIGS. 6 and 7, subsidiary independent links 30 are provided in the open spaces between the outsole pieces 33 which extend across the forepart of the sole. These links 30, which are thinner and shallower than the outsole pieces 33, and which extend from the lower surface 34 of the midsole 35 to a point above the lower surface 37 of the outsole pieces 33, are located around the periphery of the forepart to further reinforce the forepart section.

One of the principal advantages of the sole of this invention is its ease of being manufactured. A soft synthetic rubber-like elastomer such as EVA is vulcanized to produce a midsole of predetermined dimensions. Outsole pieces of predetermined shapes are formed or die-cut from a vulcanized piece of a wear-resistant rubber such as SBR. Optionally, outsole pieces can be formed or die-cut from different colored synthetic rubber or from synthetic rubber having other aesthetic or functional characteristics.

The outsole pieces 33 are then temporarily attached at predetermined locations to the lower surface of the midsole with adhesive. The outsole pieces and the midsole are then vulcanized to form a composite sole by heating at a suitable temperature for a suitable length of time. Peripheral flash can be cut off if necessary.

Although certain preferred embodiments of the invention have hereinbefore been described, it will be appreciated that variations of the invention will be perceived by those skilled in the art, which variations are nevertheless within the scope of the invention as defined by the claims appended hereto.

What is claimed is:

1. A sole comprising a relatively soft midsole made of a soft rubber-like elastomer, said midsole having upper and lower surfaces and being wedge-shaped with a relatively thick heel section and a relatively thin and flexible forepart section, and a plurality of discontinuous and independent outsole pieces of a relatively hard rubber in comparison to said midsole, said outsole pieces being disposed across the lower surface of said forepart section of said midsole and being spaced one from the other by intermediate exposed areas of said lower surface to provide flexibility in said forepart section and to increase the durability of said forepart section while minimizing the increase in the weight of the sole, and said outsole pieces being attached to the lower surface of said midsole by vulcanization to produce a composite sole.

2. The sole of claim 1, wherein said outsole pieces comprise strips extending transversely across said forepart section of said midsole.

3. The sole of claim 2, wherein said transverse outsole strips include offset portions for further enhancing the flexibility of the sole.

4. The sole of claim 3, wherein said offset portions are forwardly disposed.

5. The sole of claim 1, further comprising additional outsole pieces of a relatively hard rubber disposed at one or more of the heel, arch and toe sections of said midsole.

6. The sole of claim 5, wherein said outsole pieces include pieces made from hard rubbers having different aesthetic or functional characteristics.

7. The sole of claim 5, wherein said outsole piece at the arch region includes a central cut-out to reduce the weight of said outsole piece.

8. The sole of claim 1, wherein said midsole is made from a rubber-like elastomer selected from the group consisting of ethylene vinyl acetate and polyurethane.

9. The sole of claim 8, wherein said midsole is made from ethylene vinyl acetate.

10. The sole of claim 8, wherein said outsole pieces are made from styrene-butadiene rubber.

11. A process for making a composite sole comprising the steps of:

(a) providing a midsole made of a relatively soft rubber-like elastomer and having upper and lower surfaces, said midsole being wedge-shaped with a relatively thick heel section and a relatively thin and flexible forepart section;

(b) positioning a plurality of discontinuous independent outsole pieces made of a relatively hard rubber in comparison to the midsole material across the lower surface of said forepart section of said midsole in a mutually spaced relationship with areas of said lower surface being exposed between said outsole pieces; and (c) attaching said outsole pieces to said lower surface of said forepart section of said midsole by vulcanization to provide a composite sole.

* * * * *